US009168425B2

(12) United States Patent
Qian

(10) Patent No.: US 9,168,425 B2
(45) Date of Patent: Oct. 27, 2015

(54) MESH RACKET

(71) Applicant: NINGBO HUANYING AUTO ACCESSORIES CO., LTD., Ningbo (CN)

(72) Inventor: Xuliang Qian, Ningbo (CN)

(73) Assignee: Ningbo Huanying Auto Accessories Co., Ltd., Ningbo (CN)

( * ) Notice: Subject to any disclaimer, the term of this patent is extended or adjusted under 35 U.S.C. 154(b) by 0 days.

(21) Appl. No.: 14/310,272

(22) Filed: Jun. 20, 2014

(65) Prior Publication Data

US 2015/0065277 A1 Mar. 5, 2015

(30) Foreign Application Priority Data

Aug. 29, 2013 (CN) ..... 2013 1 0386748

(51) Int. Cl.

| | |
|---|---|
| ***A63B 49/02*** | (2015.01) |
| ***A63B 51/08*** | (2006.01) |
| ***A63B 51/12*** | (2006.01) |
| ***A63B 49/00*** | (2015.01) |

(52) U.S. Cl.

CPC ..... *A63B 51/08* (2013.01); *A63B 49/00* (2013.01); *A63B 51/12* (2013.01)

(58) Field of Classification Search

CPC .... A63B 49/00; A63B 49/002; A63B 49/005; A63B 49/02; A63B 51/08; A63B 51/00; A63B 51/12

USPC ..... 473/539, 543, 537, 540, 542, 546, 548

See application file for complete search history.

(56) References Cited

U.S. PATENT DOCUMENTS

| | | | | | |
|---|---|---|---|---|---|
| 323,608 | A * | 8/1885 | Turner | ..... | 473/543 |
| 1,188,940 | A * | 6/1916 | Johnson | ..... | 473/543 |
| 4,184,679 | A * | 1/1980 | Mishel | ..... | 473/537 |
| 4,681,319 | A * | 7/1987 | Zilinskas | ..... | 473/540 |
| 5,054,779 | A * | 10/1991 | Marrello | ..... | 473/522 |
| 5,257,781 | A * | 11/1993 | Sines et al. | ..... | 473/539 |
| 6,089,997 | A * | 7/2000 | Hauptman et al. | ..... | 473/524 |
| 6,280,355 | B1 * | 8/2001 | Hauptman et al. | ..... | 473/557 |
| 6,319,160 | B1 * | 11/2001 | Hsu | ..... | 473/540 |
| 6,336,877 | B1 * | 1/2002 | Arroyo et al. | ..... | 473/539 |

(Continued)

FOREIGN PATENT DOCUMENTS

| | | | | | |
|---|---|---|---|---|---|
| DE | 3418962 | A1 * | 10/1984 | ..... | A63B 49/02 |
| EP | 1360975 | A2 * | 11/2003 | ..... | A63B 51/08 |
| FR | 2565499 | A1 * | 12/1985 | ..... | A63B 51/08 |

(Continued)

*Primary Examiner* — Raleigh W Chiu

(74) *Attorney, Agent, or Firm* — McNees Wallace & Nurick LLC

(57) ABSTRACT

The present invention discloses a mesh racket and its manufacturing method, comprising a handle (1), a frame (2) and a string (3), wherein the handle (1) is fixed to one end of the frame (2) along the horizontal direction of the frame (2), a plurality of holes (4) are arranged on the side wall of the frame (2) for installing the string (3), characterized in that the string (3) includes the first string set (301), the second string set (302) and the third string set (303) composed by a number of parallel strings respectively, wherein the said mesh holes formed by each string set are triangular. Such a mesh racket not only features the better face performance, but also the firmer triangular mesh holes. Therefore, it is not easily deformed, thereby reducing the string changeover frequency and maintenance costs.

7 Claims, 4 Drawing Sheets

(56) References Cited

U.S. PATENT DOCUMENTS

| | | | | |
|---|---|---|---|---|
| 6,440,015 | B1 * | 8/2002 | Chang | 473/540 |
| 2003/0211908 | A1 * | 11/2003 | Matsumoto | 473/543 |

FOREIGN PATENT DOCUMENTS

| | | | | | |
|---|---|---|---|---|---|
| JP | 11206924 | A | * | 8/1999 | A63B 51/08 |
| JP | 2003325706 | A | * | 11/2003 | A63B 51/08 |

* cited by examiner

MESH RACKET

BACKGROUND OF THE INVENTION

1. Technical Field

The present invention relates to a mesh racket.

2. Description of Related Art

With the improvement of people's quality of life, more people tend to choose healthy and fun sports in their spare time. With a pair of rackets and a net, you can play badminton, tennis, and other mesh hitting sports without the need of direct physical confrontation like basketball. Besides, such sports require less on the physical fitness of the person participating and simple equipments and place. Therefore, such mesh racket hitting games are increasingly accepted by people of different ages. Take badminton and tennis rackets as examples, traditional racket strings, formed by two sets of strings, are in grid-shape, namely the main and cross strings along the vertical and horizontal directions respectively. Such two sets of strings weave over and under with each other to form multiple square holes. Such strings are widely used due to their simple manufacturing process. With the development of the mesh racket, this stringing pattern weaving the main and the cross strings is very popular. In the prior art, the improvement is embodied in the performance of the string and racket frame materials rather than the racket structure and string pattern. It is known that the impact force of the ball to the racket string is not perpendicular to the racket face. After hitting multiple times with the racket, therefore, the two adjacent parallel main and cross strings will move left or right due to the effect of the horizontal force component. Consequently, the uniform square meshes formed by the string will become many meshes with different sizes and shapes after the racket is used for a while, thereby reducing the performance of the racket face. The said performance of the racket face means the elastic deformation of the racket string face. At this time, these racket strings need replacing by professional technicians. For professional athletes with a higher hitting intensity, the service life of the string is even shorter, requiring restringing the racket for every match. Therefore, such a racket weaving the main string and the cross string has poor racket face performance and high maintenance cost.

BRIEF SUMMARY OF THE INVENTION

The present invention aims at addressing the technical problem by providing a mesh racket with better face performance and less string replacement.

Accordingly, the present invention aims at addressing another technical problem by providing a method of making a mesh racket with better face performance and less string replacement.

In terms of the mesh racket according to the present invention, the present invention provide a technical solution by providing a mesh racket with the structure below: it comprises a handle, a frame and a string, wherein the handle is fixed to one end of the frame along the horizontal direction of the frame, and a plurality of holes are arranged on the side wall of the frame for installing the string, characterized in that the string includes the first string set, the second string set and the third string set composed by a number of parallel strings respectively, the vertical distance between any two adjacent parallel strings in or between each string set is equal, wherein the first string set intersects the second string set, the third string set intersects the first string set and the second string set, and the said multiple mesh holes formed by a number of parallel strings of each string set are triangular.

As an improvement of the present invention, the angle between any two intersecting strings in each string set is 60°, and the said several mesh holes formed by a number of parallel strings of each string set are equilateral triangles.

As an improvement of the present invention, a sleeve is arranged at the inner wall of the hole to reduce the friction between the string and the inner wall of the hole. Adding sleeves can effectively reduce the friction between the string and the edge of the holes at the end face to prevent the string from breaking due to its scraping back and forth and increase the service life of the string.

Preferably, the axis of the hole is on the collinear with the corresponding string of the hole. The axial position of the hole is collinear with the corresponding string, making it frictionless between the string and the edge of the hole at the end face, thus reducing the risk of string breaking caused by the edge friction of the hole at the end face.

As another improvement of the present invention, a plurality of drum-shaped rollers are arranged on the outer side wall of the frame for supporting the string passing through the two adjacent holes, wherein flanged shafts are arranged at both ends of the drum-shaped roller, and hole slots are arranged on the frame for installing the shaft. The string is supported via the drum-shaped roller, making it limited in the middle of the drum-shaped roller with a smaller diameter during tightening. Meanwhile, small displacement drives the roller to rotate due to the string flexibility during hitting, allowing the friction between the string and the roller become rolling friction, and thus increasing the service life of the string.

Furthermore, a plurality of receiving slots are arranged on the frame for receiving the drum-shaped roller, wherein the distance from the central axis of the roller to the bottom surface of the receiving slot is more than the depth of the receiving slot. The arrangement of the receiving slot can make the drum-shaped roller rotate in the receiving slot, thereby making the roller limited axially and circumferentially without affecting the roller rotation.

As a final improvement of the present invention, a string tightening hole is arranged on the handle, wherein the string tightening hole links with the hole in the connection position between the frame and the handle, and a removable fastening device is arranged on the string tightening hole for fastening the string. With the removable fastening device arranged on the handle, the loosened string can be maintained and fastened at any time without the need for replacing the string.

Preferably, the fastening device is a lockable winch, wherein external threads are configured on the outer circumferential surface of the winch, internal threads are configured on the string tightening hole for engaging with the external threads, a hole is configured in the middle of the winch, a tightening slot is arranged on the opposite end face connecting the winch and the handle for tightening the string, the winch is attached to one end of the tightening slot fixedly and the other end of the string is fixed onto the frame.

In terms of the method of manufacturing the mesh racket according to the present invention, the technical solution adopted by the present invention to solve the above technical problems includes the following steps: first make some shaped frames with a handle, characterized in that select any point on the frame as the reference point and regard a line in one direction of the reference point as the first symmetrical line, wherein a number of parallel lines are configured on the first symmetrical line every certain vertical width distance and a first hole is configured in the intersection between the parallel line and the frame edge; select a string and thread through all the first holes along the parallel line to form the first string set, and regard another two lines in another two different directions of the reference point as the second symmetrical line and the third symmetrical line, wherein a number of parallel lines are arranged respectively with an equal space between two adjacent parallel lines in the first symmetrical line along each symmetrical line, the second hole and the third hole are arranged respectively in the intersection between two sets of parallel lines and the frame edge; and then select a string and thread it through all the second holes along the parallel line to form the second string set, wherein the second string set weaves over and under the first string set; finally, select a string and thread it through all the third holes along the parallel line to form the third string set, wherein the third string set weaves over and under the first string set and the second string set.

Preferably, the reference point is at the fixed position between the handle and the frame, the first symmetrical line is in the vertical direction of the handle, the second symmetrical line and the third symmetrical line are disposed in a 60° direction to the left and right sides of the first symmetrical line, starting holes relative to the reference point are in the starting stringing position of all strings, and the first string set is formed by two strings, wherein the two strings are strung on the left and right sides to form the first string set.

Compared with the prior art, the present invention has the following advantages with the above structure: any string intersection in the frame is formed by three strings. Therefore, compared with the traditional grid racket subject to the same pressure, such a racket features less elastic strain, greater face hardness and faster return speed. Further, in terms of the energy calculation with the same racket and string materials, it can be concluded that the racket according to the present invention features less elastic strain in the same case. For this conclusion, it will be demonstrated in detail in the embodiments. Meanwhile, compared with the square mesh, all mesh holes in the frame are equilateral triangles with greater stability. Therefore, it is not easy to misplace, thereby increasing the service life of the mesh racket string and reducing the string replacement frequency.

As shown in figures below: 1. Handle, 101. String tightening hole, 2. Frame, 3. String, 301. First string set, 302. Second string set, 303. Third string set, 4. Through hole, 401. Starting through hole, 5. Sleeve, 6. Drum-shaped roller, 601. Flanged shaft, 7. Receiving slot, 8. Fastening device, 801. Tightening slot.

DETAILED DESCRIPTION OF THE INVENTION

The present invention is further detailed in combination with the drawings and the detailed embodiments below.

Figure 1:
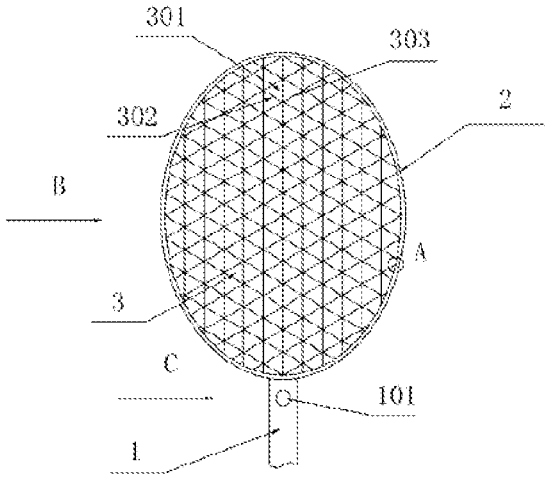
FIG. 1 is the schematic view of the mesh racket.
Figure 2:
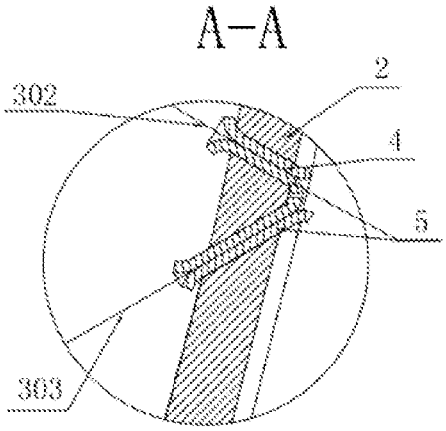
FIG. 2 is the enlarged view of "A" in FIG. 1.

As shown in FIG. 1 and FIG. 2, a mesh racket according to the present invention, comprising a handle 1, a frame 2 and a string 3, wherein the handle 1 is fixed to one end of the frame 2 along the horizontal direction of the frame 2, and a plurality of holes 4 are arranged on the side wall of the frame 2 for installing the string 3, wherein the string 3 includes the first string set 301, the second string set 302 and the third string set 303 composed by a number of parallel strings in the same plane respectively, and the vertical distance between any two adjacent parallel strings in each string set is equal; namely, the vertical distance between any two adjacent parallel strings in each string set or in different string sets is the same. Furthermore, each string set intersects each other; namely, the first string set 301 intersects the second string set 302, and the third string set 303 intersects the first string set 301 and the second string set 302. As a preferred embodiment, the angle between any two intersecting strings is 60°, and the said mesh holes formed by a number of parallel strings of each string set are equilateral triangles. The said mesh holes are equilateral triangles, which means that the mesh holes formed by all strings must be equilateral triangles and isosceles trapezoids when the parallel strings with an equal distance intersects each other in each set and the angle is 60°. The mesh holes formed by the three sets of parallel strings must be equilateral triangles and the size of the equilateral triangle depends on the vertical distance between any two adjacent parallel strings only when the three parallel strings with the equal distance intersect each other in each set. The equal distance is the vertical distance between any two adjacent parallel strings in each string set. Of course, the vertical distance between any two adjacent parallel strings is preferably in the range of 0.1 mm-100 mm. Furthermore, the mesh holes formed by the frame string and the frame edge are irregularly shaped, wherein the size must be less than the equilateral triangle and the holes are in the contact edge between the string and the frame. Therefore, its effect on the face performance of the racket is less.

Preferably, a sleeve 5 is arranged at the inner wall of the hole 4 to reduce the continuous scraping between the tightened string 3 and the end face edge of the hole 4 for fixing the string during hitting. In terms of the sleeve, soft PVC materials can be adopted. The axial length of the sleeve 5 can be slightly longer than that of the hole 4. The portion exceeding the hole 4 can be folded and fitted on the end face of the hole to form a circle of annular sleeve edges so as to separate the string from the sharp edge of the hole 4 at the end face effectively.

Furthermore, the axial position of the hole 4 is collinear with the corresponding string 3, wherein the string tension is balanced by the axial tension of the hole, and therefore the end face edge of the hole has no tangential force on the string. During hitting, the string will have no contact with the end face edge of the hole due to its subtle vibration. Even for some slight contact, the friction is small.

Figure 3:
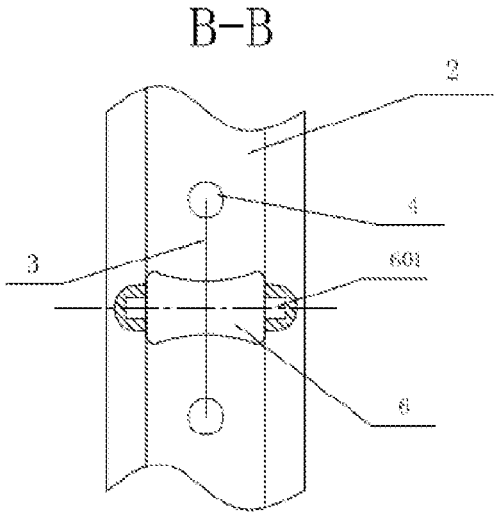
FIG. 3 is the partial enlarged side view of "B" in FIG. 1.

As shown in FIG. 3, to further reduce the friction between the string and the frame edge, a plurality of drum-shaped rollers 6 are arranged on the outer side wall of the frame 2 for supporting the string 3 passing through two adjacent holes, wherein the drum-shaped roller is cylindrical with the diameter in the middle less than that at both ends. Of course, flanged shafts 601 are arranged at both ends of the drum-shaped roller 6 to fix the roller 6 and prevent the roller from falling, and hole slots are arranged on the frame 2 for installing the shaft 6. Namely, the shaft 601 is cylindrical, wherein the shaft 601 is limited in the corresponding circular hole slots arranged on both sides of the frame, thus making the shaft to rotate freely with the roller.

Figure 4:
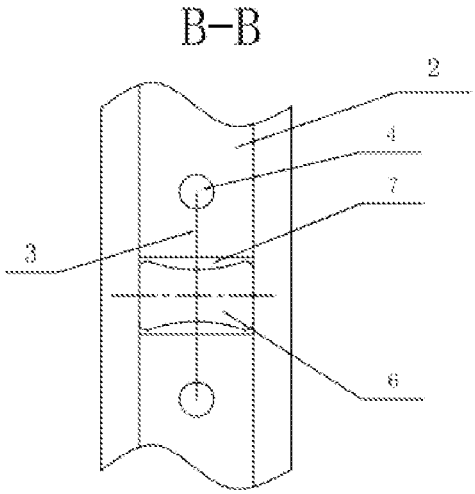
FIG. 4 is the another structure of FIG. 3.

Preferably, as shown in FIG. 4, a receiving slot 7 is arranged on the frame 2 for receiving the drum-shaped roller 6, wherein the length and width of the rectangle receiving slot is slightly larger those of the roller, and the distance from the central axis of the roller to the bottom surface of the receiving slot is more than the depth of the receiving slot. Thus, the string 3 arranged on the drum-shaped roller cannot contact with the frame 2, allowing the sliding friction between the original string 3 and the frame 2 become rolling friction between the drum-shaped roller 6 and the string 3.

Figure 5:
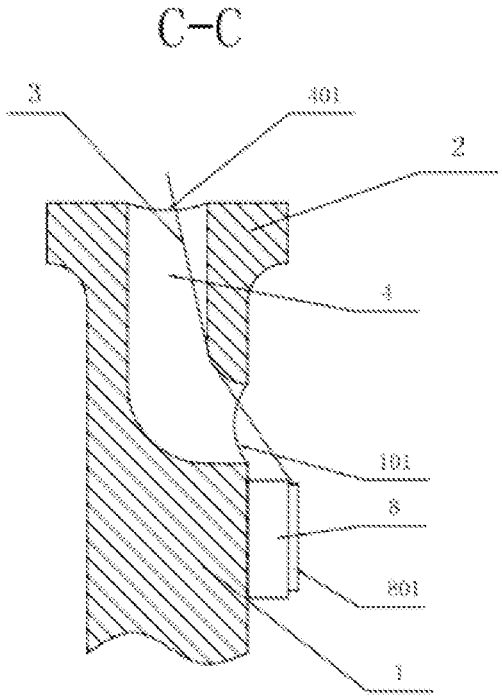
FIG. 5 is the partial enlarged semi-sectional side view of "C" in FIG. 1

Furthermore, the present invention proposes a preferred embodiment to reduce unnecessary re-string caused by loosened strings rather than string breaking. As shown in FIG. 5, a string tightening hole 101 is arranged on the handle 1, wherein the string tightening hole 101 links with the hole in the connection position between the bottom end of the frame 2 and the handle 1. Therefore, one end of multiple strings 3 to be thread through the main hole 401 and finishes the stringing via the string tightening hole 101, wherein one end of all strings is fixed on the frame 2 and the other end connects with the fastening device 8 arranged on the string tightening hole 101. The fastening device 8 is a lockable winch, wherein external threads are configured on the outer circumferential surface of the winch, internal threads are configured on the string tightening hole 101 to engage the external threads, a tightening slot 801 is arranged on the opposite end face connecting the winch and the handle 1 for tightening the string, all strings are fixedly attached to one end of the tightening slot 801 and the other end of the string is fixed onto the frame 2. During the winch tightening via the screw rotation, the string 3 is wound into the tightening slot 801, thus making the string 3 tightened.

Of course, the fixing between the handle 1 and the frame is not only limited to the direct fixing mentioned in the embodiment. It can be fixedly connected by two left and right connecting rods. Consequently, the favorable effect is that the fastening device can be arranged in the cavity between the frame 2, handle 1 and left & right connecting rods.

Figure 6:
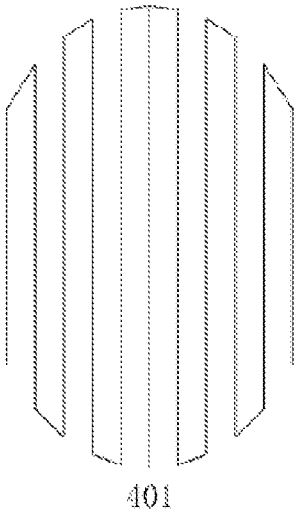
FIG. 6 is the string pattern of the first string set
Figure 7:
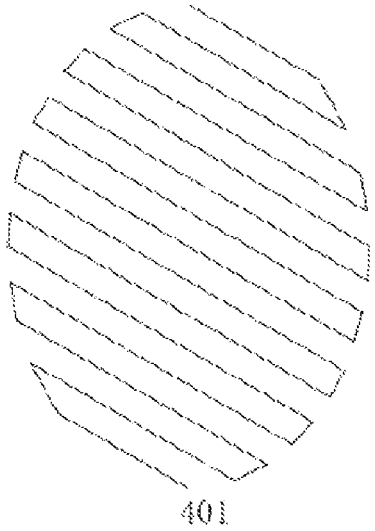
FIG. 7 is the string pattern of the second string set
Figure 8:
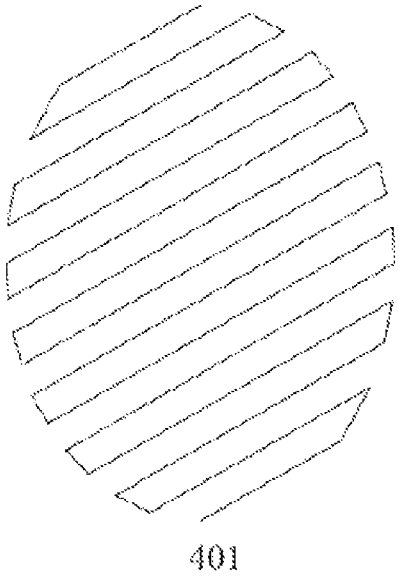
FIG. 8 is the string pattern of the third string set

Taking the oval frame as an example, all the stringing steps are illustrated below:

As shown in the stringing pattern of the first string set in FIG. 6, the first string set is formed by two strings, wherein the two strings thread through the hole vertically at the top of the frame 2 via the starting hole 401, then through the adjacent first hole at the left and right sides respectively and finally through the first hole at the bottom end vertically. Then, the horizontal "S"-shaped two strings are arranged from the middle to the left and right sides. Finally, the two strings of the first string set are fixed onto the frame 2. As shown in the stringing pattern of the second string set in FIG. 7, the second string set is formed by one string, wherein the string rotates 60° vertically towards the left side and is arranged repeatedly in the tilted "S" shape with the second hole from the starting hole 401. Similarly, as shown in the stringing pattern of the third string set in FIG. 8, the third string set is also formed by one string, wherein the string rotates 60° vertically towards the right side and is arranged repeatedly in the tilted "S" shape with the third hole. The said first hole, the second hole and the third hole refer to the hole 4 on the frame 2 relative to the first string set, the second string set and the third string set.

The method of manufacturing a number of first holes, second holes, and third holes arranged on the side wall of the frame are described below: regard the vertical line on the handle 1 arranged on the left and right symmetrical centerlines at the bottom end of the frame 2 as the first symmetrical line. The upper and the lower first holes are arranged on the side wall of the frame 2 along the left and right sides of the first symmetrical line every certain horizontal width; namely, the first hole is formed by a row of symmetrical holes with certain space from up to down and left to right. The certain horizontal distance is the fixed width calculated to decide the size of the mesh hole. Then, take the fixed position between the handle 1 and the frame 2 as the reference point, allowing the vertical centerline to rotate 60° towards the left side around the reference point to form the second symmetrical line and regarding the linear direction of the second symmetrical line as the vertical direction, wherein the upper and the lower second holes are arranged on the side wall of the frame 2 along the left and right sides of the second symmetrical line every distance of the same width. Similarly, take the fixed position between the handle 1 and the frame 2 as the reference point, allowing the vertical centerline to rotate 60° towards the right side around the reference point to form the third symmetrical line and regarding the linear direction of the third symmetrical line as the vertical direction, wherein the upper and the lower third holes are arranged on the side wall of the frame 2 along the left and right sides of the third symmetrical line every distance of the same width.

Of course, each string set can be strung simultaneously in the respective hole, and each string set weaves over and under the other string sets at multiple intersections formed by them. Namely, the first string set is located at the top end in terms of a certain intersection, wherein the first string set is located in the middle or bottom end in the adjacent string, and the upper and lower position of the string are alternative in the three string sets.

The principles of the mesh racket to provide the superior face performance according to the present invention are detailed below:

As shown in FIG. 5 and FIG. 6, a slight angular displacement $\phi$ occurs to the center of the string fixed at both ends. Since we discuss the small deformation so $\phi \approx \tan\phi \approx \sin\phi$;

By composition of force: $F_{synthesis} = 2Fn \cdot \sin\phi$ (Equation 1)

By the geometric relationship:

$$\Delta L = L \cdot \left(\frac{1}{\cos\phi} - 1\right) \quad \text{(Equation 2)}$$

According to the equation of elasticity:

$$\frac{F_n}{A} = E \cdot \frac{\Delta L}{L} \quad \text{(Equation 3)}$$

Take (Equation 1) (Equation 2) into the (Equation 3):
Yield:

$$F_n = E \cdot A \cdot \left(\frac{1}{\cos\phi} - 1\right) \text{ and } F_{synthesis} = 2E \cdot A \cdot (\tan\varphi \approx \sin\varphi) \quad \text{(Equation 4)}$$

Wherein:

$F_n$ is the force component on each string;

$F_{synthesis}$ is the elastic force composition generated by the racket string;

$\Delta L$ is the string deformation in length;

$\Phi$ is the elastic deformation angle of the string;

E is the elastic modulus of inherent materials;

A is the area under force

Now take the same force on the racket while hitting the ball as an example:

In the mesh hole of the equilateral triangle according to the present invention, a small angular displacement $\omega'$ occurs downward at certain node (the impact of other strings is ignored); the deformed node will be subject to the components of three strings in the cell:

$$F_{synthesis}=6E\cdot A\cdot(\tan\phi-\sin\phi) \quad \text{(Equation 5)}$$

In the conventional cross-intersecting string, the deformed node will be subject to the components of two strings in the cell. Therefore, when $F_{synthesis}=F_{synthesis}'$, then $$\sqrt[3]{\frac{3}{2}}\,\varphi \approx \varphi';$$

namely, $\phi$ is smaller than $\phi'$.

Wherein:

$F_{synthesis}'$ is the resultant elastic force generated by the square mesh hole of the conventional racket;

$\phi'$ is the deformation angle suffered by the square mesh hole of the conventional racket.

Considering from the energy point of view:

Take a ball hitting racket with the string material PA66 as an example. Select E=3.5 GPa with a diameter d=1.5 mm, I=1 cm, weight force of the ball is 1N and velocity is 20 m/s. There are n=100 cells which have stored the energy.

One cell according to the present invention can store energy as below:

$$\int\int_j = \int_{t_1}^{t_1} F_{synthesis}\cdot ds = \int_0^{\phi} 6E\cdot A\cdot(\tan\varphi-\sin\varphi)\cdot d(l\cdot\tan\varphi) = 6E\cdot A\cdot l\cdot\int_0^{\varphi}(\tan\varphi-\sin\varphi)\cdot d\ \tan\varphi$$

$$\nabla\int(\tan\phi-\sin(\phi)d\tan\phi) = \frac{1/2-\cos(\phi)}{\cos(\phi)^2}$$

$$\Delta\frac{1}{2}mv^2 = 6nE\cdot A\cdot l\cdot\int_0^{\arctan\phi_u}\left(x-\frac{x}{\sqrt{1+x^2}}\right)\cdot dx$$

Substituting data:

$$\frac{1}{2}\cdot\frac{1}{9.8}\cdot(20)^2 = 6\cdot 100\cdot 3.5\times 10^9\cdot\frac{\pi}{4}\cdot(0.0015)^2\cdot 0.01\cdot\int_0^{\arctan\varphi_0}\left(x-\frac{x}{\sqrt{1+x^2}}\right)\cdot dx$$

$$\therefore \varphi_0 = 0.26\text{rad}$$

One cell of the conventional mesh racket can store energy as below:

$$\int\int_j = \int_0^{t} F_{synthesis}\cdot ds = 4EA\cdot\int_0^{t}(\tan\varphi-\sin\varphi)\cdot d(l\cdot\tan\varphi) = 4E\cdot A\cdot l\cdot\int_0^{t}(\tan\varphi-\sin\varphi)\cdot d\ \tan\varphi$$

$$\therefore \frac{1}{2}mv^2 = 4nE\cdot A\cdot l\cdot\int_0^{\arctan\varphi_0}\left(x-\frac{x}{\sqrt{1+x^2}}\right)\cdot dx$$

Substituting data:

$$\frac{1}{2}\cdot\frac{1}{9.8}\cdot(20)^2 = 4\cdot 100\cdot 3.5\times 10^9\cdot\frac{\pi}{4}\cdot(0.0015)^2\cdot 0.01\cdot\int_0^{\arctan\varphi_0}\left(x-\frac{x}{\sqrt{1+x^2}}\right)\cdot dx$$

$$\therefore \varphi_0 = 0.28\text{rad}$$

Therefore, considering from the energy point of view, the strain angular displacement of the present invention is obviously less than the conventional mesh racket for the same energy of the incoming ball. On the other hand, the present utility model can store 2 times the energy of a conventional mesh string for the same string deformation. We will not repeat the calculation as the inverse process of the above equations.

In summary, the angular displacement and deformation according to the present invention are smaller than the conventional racket when the same ball hits the two structures. Consequently, the structure is not easily damaged. In actual applications, taking badminton and tennis rackets as examples, the return speed is faster when players play with each other.

The above described are just preferred embodiments of the present invention. They do not constitute restriction to the protection scope of the present invention. Any modification, equivalent replacement and improvement based on the sprit and principle of the present invention shall be covered within the protection scope claimed by the present invention.

What is claimed is:

1. A mesh racket, comprising a handle, a frame and a string, wherein the handle is fixed to one end of the frame along the horizontal direction of the frame, and a plurality of holes are arranged on the side wall of the frame for installing the string, characterized in that the string includes the first string set, the second string set and the third string set composed by a number of parallel lines respectively, the vertical distance between any two adjacent parallel lines in or between each string set is equal, wherein the first string set intersects the second string set, the third string set-intersects the first string set and the second string set and the said several mesh holes formed by a number of parallel lines of each string set are triangular;

a plurality of drum-shaped rollers are arranged on the outer side wall of the frame for supporting the string passing through the two adjacent holes, wherein flanged shafts are arranged at both ends of the drum-shaped roller and hole slots are arranged on the frame for installing the shaft.

2. The mesh racket according to claim 1, characterized in that the angle between any two intersecting lines in each string set is 60°, and the said mesh holes formed by a number of parallel lines of each string set are equilateral triangles.

3. The mesh racket according to claim 1, characterized in that a sleeve is arranged at the inner wall of the hole to reduce the friction between the string and the inner wall of the hole.

4. The mesh racket according to claim 1, characterized in that the axis of the hole is collinear with the corresponding string of the hole.

5. The mesh racket according to claim 1, characterized in that a plurality of receiving slots are arranged on the frame for receiving the drum-shaped roller, wherein the distance from the central axis of the roller to the bottom surface of the receiving slot is more than the depth of the receiving slot.

6. A mesh racket, comprising a handle, a frame and a string, wherein the handle is fixed to one end of the frame along the horizontal direction of the frame, and a plurality of holes are arranged on the side wall of the frame for installing the string, characterized in that the string includes the first string set, the second string set and the third string set composed by a number of parallel lines respectively, the vertical distance between any two adjacent parallel lines in or between each string set is equal, wherein the first string set intersects the second string set, the third string set intersects the first string set and the second string set, and the said several mesh holes formed by a number of parallel lines of each string set are triangular a string tightening hole is arranged in the handle, wherein the string tightening hole links with the starting hole in the connection position between the frame and the handle, and a removable fastening device is arranged on the string tightening hole for fastening the string.

7. The mesh racket according to claim 6, characterized in that the fastening device is a lockable winch, wherein external threads are configured on the outer circumferential surface of the winch, internal threads are configured on the string tightening hole for engaging with the external threads, a hole is configured in the middle of the winch, a tightening slot is arranged on the opposite end face connecting the winch and the handle for tightening the string, the string is fixedly attached to one end of the tightening slot and the other end of the string is fixed onto the frame.

* * * * *